US008152971B2

(12) United States Patent
Quinto et al.

(10) Patent No.: US 8,152,971 B2
(45) Date of Patent: Apr. 10, 2012

(54) CUTTING TOOL

(75) Inventors: Dennis T. Quinto, North Tonawanda, NY (US); Christian Wohlrab, Feldkirch (AT); Jurgen Ramm, Maienfeld (CH)

(73) Assignee: Oerlikon Trading AG, Truebbach, Truebbach (SE)

( * ) Notice: Subject to any disclaimer, the term of this patent is extended or adjusted under 35 U.S.C. 154(b) by 0 days.

(21) Appl. No.: 13/248,910

(22) Filed: Sep. 29, 2011

(65) Prior Publication Data

US 2012/0021137 A1 Jan. 26, 2012

Related U.S. Application Data

(62) Division of application No. 11/749,498, filed on May 16, 2007.

(51) Int. Cl.
*C23C 16/00* (2006.01)

(52) U.S. Cl. ..... 204/192.16; 204/192.15; 407/119; 427/419.7

(58) Field of Classification Search ..... 204/192.15, 204/192.16; 407/119; 427/419.7
See application file for complete search history.

(56) References Cited

U.S. PATENT DOCUMENTS

| | | | |
|---|---|---|---|
| 3,882,581 | A | 5/1975 | Mereness et al. |
| 3,909,895 | A | 10/1975 | Abrahamson et al. |
| 4,610,931 | A | 9/1986 | Nemeth et al. |
| 5,250,367 | A | 10/1993 | Santhanam et al. |
| 5,266,388 | A | 11/1993 | Santhanam et al. |
| 5,310,607 | A | 5/1994 | Schulz et al. |
| 6,612,786 | B1 | 9/2003 | Kanada et al. |
| 6,767,627 | B2 | 7/2004 | Morikawa et al. |
| 7,232,603 | B2 | 6/2007 | Hessman |
| 2001/0003569 | A1 | 6/2001 | Ota et al. |
| 2002/0081161 | A1 | 6/2002 | Yamada et al. |
| 2008/0090099 | A1 | 4/2008 | Ramm et al. |
| 2008/0253850 | A1 | 10/2008 | Moriguchi et al. |

FOREIGN PATENT DOCUMENTS

| | | |
|---|---|---|
| CH | 1166/03 | 7/1925 |
| CH | 01614/06 | 2/1932 |
| JP | 2001347403 | 12/2001 |
| JP | 2004122264 | 4/2004 |
| WO | WO 2005/089990 | 9/2005 |
| WO | WO 2006/099754 | 9/2006 |
| WO | WO 2006/099758 | 9/2006 |
| WO | WO 2006/099760 | 9/2006 |

*Primary Examiner* — Archene Turner

(74) *Attorney, Agent, or Firm* — Notaro, Michalos & Zaccaria P.C.

(57) ABSTRACT

A method for manufacturing a cutting tool includes the steps of providing a body of cermet or cemented carbide, having a cutting edge with an edge radius $R_e$ smaller than 40 μm, a flank a rake face, applying by PVD a single or a multilayer coating to at least a part of the surface of the body, comprising at least a part of the cutting edge and applying by PVD said single or multilayer coating, comprising PVD coating with at least one oxidic layer.

30 Claims, No Drawings

CUTTING TOOL

CROSS-REFERENCE TO RELATED APPLICATION

This is a divisional of application Ser. No. 11/749,498 filed May 16, 2007 and incorporated here by reference.

FIELD AND BACKGROUND OF THE INVENTION

The present invention relates to the field of coated sharp edged cutting tools made of or comprising a sintered body embracing at least a hard material and a binder material which has been sintered under temperature and pressure to form the body.

With past and current sintering technology of powder metallurgy cemented carbide cutting tools have been used both in uncoated and in CVD and PVD coated conditions. CVD as well as MT-CVD coating processes need high temperatures, usually above 950° C. for HT-CVD or between 800° C. and 900° C. for MT-CVD, and a chemically aggressive process atmosphere. This has, amongst others, well known drawbacks with reference to transverse rupture strength (TRS) and low edge strength of the cutting tools as well as to unavoidable thermal cracks of the coating.

A closer look to the drawbacks of HT (high temperature)-CVD should be given in the following with the coating of cemented carbides taken as an example:

a) As mentioned, reduction of TRS of the substrate—may be due to the fact that the surface state prior to coating is one of residual compressive stress induced by the correct grinding process, which is beneficial; this state is altered by high temperature which relieves this beneficial residual compressive stress. Therefore, independent of the coating, high temperature annealing has this effect on the carbide substrate. However, even if the substrate is not properly ground—for instance, if it is subjected to "abusive grinding" which leaves residual tensile stress or even some surface cracks—the high temperature treatment has essentially no beneficial effect.

b) A further reduction of the TRS of the coated tool comes from the presence of thermal cracks induced by thermal expansion mismatch between the coating and substrate upon cooldown from the high CVD temperature. The cracks run through the thickness of the coating, and thus can initiate fatigue failure under certain cutting conditions.

c) In the case of WC—Co hardmetals, it is also known that cobalt diffuses towards the surface with temperatures of about 850° C. and above which is also associated with decarburization and eta phase formation during the CVD process. Such eta phase can e.g. be formed by the decarburization of the outer region of the substrate in the initial formation of TiC or TiCN CVD first layer which is the usual underlayer for CVD $Al_2O_3$ coating layer. The eta phase region forms an embrittled layer with high porosity, again causing micro-cracking initiation sites as well as coating delamination tendency. At least this drawback of HT-CVD has been overcome with MT (medium temperature)-CVD e.g. by applying a first TiCN layer at about 850° C., thereby minimizing substrate eta phase formation.

Therefore different measures have been taken to diminish such detrimental effects. U.S. Pat. No. 4,610,931 suggests using cemented carbide bodies having a binder enrichment near the peripheral surface. In U.S. Pat. No. 5,266,388 and U.S. Pat. No. 5,250,367 application of a CVD coating being in a state of residual tensile stress followed by a PVD coating being in a state of residual compressive stress has been suggested for as mentioned binder enriched tools.

Despite the fact that cemented carbides have been used to illustrate the drawbacks of CVD coating processes above the same or at least similar problems are known from other substrates having sintered bodies. Cermets also have Co, Ni (and other metals like Mo, Al, . . . ) binders and undergo a sintering process similar to cemented carbides. TiCN-based cermets e.g. are not as readily CVD-coated today as these substrates are more reactive with the coating gas species, causing an unwanted reaction layer at the interface. Superhard CBN tools use high-temperature high-pressure sintering techniques different from that used for carbides and cermets. However they may also have metallic binders such as Co, Ni, . . . tending to high temperature reactions during CVD coating processes. These substrates are sometimes PVD-coated with TiN, TiAlN, CrAlN or other coating systems mostly for wear indication at the cutting edges. Such coatings however can only give a limited protection against high temperature and high oxidative stress due to high cutting speeds applied with state of the art turning machines as example.

Ceramic tool materials based on solid $Al_2O_3$, $Al_2O_3$—TiC; or $Al_2O_3$—$Si_3N_4$ (SiAlON) that incorporate glassy phases as binders represent another tool type which are electrically insulating and therefore difficult to coat also with conventional PVD. These materials are sinter-HIPped, as opposed to lower-pressure sintered carbides. Such ceramic inserts again are not CVD coated because high temperature can cause softening of the $Si_3N_4$ substrate or cause it to lose some toughness as the amorphous glassy binder phase becomes crystalline. Uncoated materials however can allow interaction during metal cutting between their binder phases and the workpiece material and therefore are susceptible to cratering wear restricting use of such tools to limited niche applications.

Therefore PVD coatings have replaced CVD coatings in parts or even completely for many operations with high demands on tool toughness or special needs on geometry. Examples for such tools are tools used for interrupted cut applications like milling or particularly sharp-edged threading and tapping tools. However due to outstanding thermochemical resistivity and hot hardness, oxidic CVD-coatings as e.g. $Al_2O_3$ in $\alpha$- and/or $\gamma$-crystal structure, or with needed thick multilayers comprising such coatings are still in widespread use especially for rough-medium turning, parting and grooving applications in all types of materials and nearly exclusively with turning of cast iron. Such coatings could not be produced by PVD processes until recently due to principal process restrictions with electrically insulating materials and especially with oxidic coatings.

As is well known to the person of ordinary skill in the art all the problems as mentioned above tend to occur and focus on the cutting edge becoming more acute with the smaller radius of the cutting edge. Therefore to avoid edge chipping or breaking with CVD coated tools additional geometrical limitations have to be considered for cutting edges and tool tips, with cutting edges limited to a minimum radius of 40 μm for cemented carbides for example. Additionally further measures like applying a chamfer, a waterfall, a wiper or any other special geometry to the clearance flank, the rake face or both faces of the cutting edge are commonly used but add another often complex-to-handle production step to manufacturing of sintered tool substrates.

SUMMARY OF THE INVENTION

It is therefore the object of the invention to provide a single or a multilayer PVD coated sharp edged cutting tool, which can at the same time exhibit satisfactory wear and thermochemical resistance as well as resistance to edge chipping. Whereby the cutting tool comprises a sintered body made of a cemented carbide, a CBN, a cermet or a ceramic material having a cutting edge with an edge radius $R_e$, a flank and a rake face and a multilayer coating consisting of a PVD coating comprising at least one oxidic PVD layer covering at least parts of the surface of the sintered body. In one embodiment the edge radius $R_e$ is smaller than 40 μm, preferably smaller than or equal to 30 μm. The covered parts of the surface comprise at least some parts of the sharp edge of the sintered body. It should be mentioned that if after sharpening of the tool there is not any posttreatment like honing, blunting or the like applied, an edge radius $R_e$ equal or even smaller than 20 μm can be fabricated on sintered tools. Also these tools can be coated beneficially with oxidic PVD coatings as there is not any harmful influence of the coating process and weakening of the cutting edge does not occur.

The coating is free of thermal cracks and does not contain any halogenides or other contaminations deriving from CVD process gases. Additionally the coating or at least the oxidic PVD layer can be free of inert elements like He, Ar, Kr and the like. This can be effected by vacuum arc deposition in a pure reactive gas atmosphere. As an example for a multilayer coating deposition of an adhesion layer and or a hard, wear protective layer can be started in a nitrogen atmosphere followed by a process step characterized by growing oxygen flow to produce a gradient towards the oxidic coating accompanied or followed by a ramp down or shut down of the nitrogen flow. Applying a small vertical magnetic field over a surface area of the cathodic arc target may be beneficial in case of highly insulating target surfaces formed e.g. by arc processes under pure oxygen atmosphere. Detailed instructions how to perform such coating processes can be found in applications WO 2006-099758, WO 2006-099760, WO 2006-099754, as well as in CH 1166/03 which hereby are incorporated by reference to be a part of the actual disclosure.

The oxidic layer will preferably incorporate an electrically insulating oxide comprising at least one element selected from the group of transition metals of the IV, V, VI group of the periodic system and Al, Si, Fe, Co, Ni, Co, Y, La. $(Al_{1-x}Cr_x)_2O_3$ and $Al_2O_3$ are two important examples of such materials. Crystal structure of such oxides can vary and may comprise a cubic or a hexagonal lattice like an alpha (α), beta (β), gamma (γ), delta (δ) phase or a spinel-structure. As for example oxide layers comprising films of different oxides can be applied to the tool. Despite of the fact that multilayer coatings may comprise nitrides, carbonitrides, oxinitrides, borides and the like from as mentioned elements having sharp or graded transfer zones between defined layers of different elemental or stoichiometric composition, it should be mentioned that best protection against high temperature and or high oxidative stress can be ensured only by a coating comprising at least one layer consisting of essentially pure oxides.

Forming a thermodynamic stable phase the corundum type structure which for example can be of the type $Al_2O_3$, $(AlCr)_2O_3$, $(AlV)_2O_3$ or more generally of the type $(Me1_{1-x}Me2_x)_2O_3$, where $0.2 \leqq x \leqq 0.98$ and Me1 and Me2 are different elements from the group Al, Cr, Fe, Li, Mg, Mn, Nb, Ti, Sb or V, will be a preferred embodiment of the oxidic layer. Detailed instructions how to perform such corundum type single or multilayered structures can be found in application CH 01614/06 which hereby is incorporated by reference.

In an embodiment of the actual invention the coating comprises an adhesion layer situated directly on the body surface, and/or at least one hard wear protective layer situated between the body and the oxidic layer or between two or more consecutive oxidic layers and/or on top of the coating layers. The adhesion layer as well as the wear protective layer thereby preferably comprises at least one element of the group of a transition metal from group IV, V, VI of the periodic system of the elements and of Al, Si, Fe, Ni, Co, Y, La. The elements of the wear protective layer will further comprise compounds of N, C, O, B or a mixture thereof, whereby N, C and CN are preferred. Examples of such wear protective layers are TiN, TiC, CrN, CrC, TiAlN, CrAlN, TiCrAlN as well as TiCN, CrCN, TiAlCN, CrAlCN, TiCrAlCN.

Elements of the adhesion layer may comprise compounds of N, C, O or a mixture thereof, whereby N and O is preferred. Examples of such adhesion layers are TiN, CrN, TiAlN, CrAlN, TiCrAlN or TiON, CrON, TiAlON, CrAlON, TiCrAlON. Thickness of the adhesion layer will be preferrably between 0.1 to 1.5 μm, both. If the adhesion layer comprises a thin metallic layer situated directly on the body surface thickness of the metallic layer should be between 10 to 200 nm to give an optimized tool to coating bond. Examples of such metallic interlayers are Ti, Cr, TiAl or CrAl. Overall coating thickness will be between 2 to 30 μm, due to economy of the coating process in most cases rather between 3 to 10 μm. However it should be mentioned that in principle tools can be provided with even thicker coatings if there is a need for some special applications which might be high speed turning in cast iron e.g.

Another embodiment of the invention may encompass a wear protective layer comprising at least one composition segregated film embracing a phase having a relatively high concentration of a specific element fostering phase segregation of crystal structures like Si or B as an example and a phase having a relatively low concentration of such a specific element. In one embodiment the phase having a relatively high concentration of the specific element constitutes an amorphous or microcrystalline phase. Such films will preferably comprise a nitride or carbonitride of a combination of Cr and Si or Ti and Si.

All layers may be deposited up to the actual needs with sharp or gradient layer to layer transition zones forming coatings showing a discrete or a gradient layer structure. Thickness of layers may be chosen from several micrometers down to a few nanometers if such structures should be preferable for specific applications.

Contrary to cutting tools comprising oxidic CVD layers such PVD coated tools need no binder enriched substrates to minimize the adverse effect of the CVD process to the TRS of the sintered body. Low process temperatures with PVD processes and the chance to apply coatings or certain layers, especially as mentioned wear protective layers, in a state of compressive stress proved to be useful measures against crack propagation and the risk of edge chipping. Therefore there is no longer use for binder enriched substrates for the majority of the actual cutting applications, which is an evident simplification for carbide tool production.

However under certain cutting conditions even PVD coated enriched carbide grades might be useful for example if cutting parameters should be extended such that higher feed force is applied and an even higher TRS would be preferred.

Due to the potential higher TRS of such PVD coated hardmetal grades not only cutting tools having a very small edge radius but also cutting tools having a smaller nose radius or point angle can be produced for special fine tooling applications. As an example compared to actual cemented carbide inserts having common nose radii of minimal 0.2 mm (0.008 inch) to 2.4 mm (0.094 inch) even radii like 0.15, 0.10, 0.05 and 0.01 mm could be coated and tested under usual fine turning conditions without signs of premature tip chipping.

Due to inherent "geometric" properties of PVD processes a further coating feature can be given to certain sintered bodies of simple geometry—as e.g. inserts—only by using defined fixturing systems thereby exposing certain areas of the body to a "direct" ions and/or neutrals flow—in the following called particle flow—from the arc or sputter source, whereas other areas are essentially hit by grazing or indirect incident only. In this context "direct" means that an essential part of the particles emitted by the arc source hit the surface in an angle of about 90±15°. Therefore layer growth on such areas is faster than growth on areas exposed to a substantially "indirect" particle flow. This effect can be used to apply coatings of different thickness during one PVD coating process which is completely different from CVD processes providing a uniform coating thickness on every surface independent from geometric effects due to different substrate/source positioning.

As for example using a threefold rotating spindle to fixture center holed square 13×13×5 mm inserts alternating with 8 mm spacers a ratio of the flank face thickness ($d_{Flank}$) and the rake face thickness ($d_{Rake}$) of about 2±0.5 could be adjusted for the inserts over the whole length of the substrate carousel of about 500 mm in a commercial Oerlikon coating unit of the RCS type, or of a length of about 900 mm in a commercially available Oerlikon BAI 1200 coating unit. Thickness measurements were made in the middle of the flank face and for the rake face at the bisecting line connecting two opposite noses of the insert in 2 mm distance from e cutting edges defining the point angle of the nose. Such inserts having a quotient $Q_{R/F}=d_{Rake}/d_{Flank}<1$, where $d_{Rake}$ is the overall coating thickness on the rake face and $d_{Flank}$ is the overall coating thickness on the flank face, are particularly convenient for milling tools which due to impact stress during milling operations profit from a higher PVD coating thickness on the flank phase. This effect is intensified by PVD coatings having a high residual stress which can be controlled by process parameters like substrate bias, total pressure and the like.

Contrary to milling, wear resistance of turning operations benefits from a higher coating thickness on the rake face due to the high abrasive and thermochemical wear caused by the passing chip. Therefore in this case quotient $Q_{R/F}$ should be higher than 1: $Q_{R/F}=d_{Rake}/d_{Flank}>1$. As for inserts such a coating distribution can be produced by fixtures exposing the rake phase to direct particle flow of the arc or sputter source. Two fold rotating magnetic fixtures as for example can be used to expose a rake face of cemented carbide made inserts directly to the source. This magnetic fixture results in additional thickness enhancement at the cutting edge which can be influenced by process parameters like substrate bias and can be utilized to improve the tool performance. For non magnetic cutting plates clamping or hooking fixtures can be used up to the needs. Further on for turning tools a coating design comprising a wear protective layer made of TiN, TiC or TiCN, TiAlN or TiAlCN, AlCrN or AlCrCN situated between the body and the oxidic layer proved to be especially effective.

Invented cutting tools are applicable to a large variety of different workpiece materials as for instance all types of metals, like nonferrous metals but especially ferrous metals, cast iron and the like. Special tools for milling or turning of such materials can be optimized as mentioned above. This makes PVD coatings a serious competitor to up to date CVD coatings even in until now untouched CVD fields like turning operations especially roughing and high speed finishing of steels and cast irons.

In many cutting applications, tools having an oxidic layer as the outermost layer of the coating system proved to be the best solution. This refers especially to gear cutting tools, hobs or different types of shank type tools including indexable shank type tools.

The following examples are intended to demonstrate beneficial effects of the invention with some special tools and coatings and are not intended in any way to limit the scope of the invention to such special examples. It should be mentioned that several tests have been performed in comparison to well known applications where PVD coated tools are known to outperform CVD coatings for a long time as e.g. with threading and drilling in different types of metal materials, for dry and wet milling of non-ferrous materials, as well as for certain milling and turning applications on steel or super alloys. For such steel milling low or medium speed up to 100 m/min but up to high feed rates from 0.2 till 0.4 mm/tooth has been applied. In most cases inventive tools performed as well or even better than well known TiCN or TiAlN based PVD coated tools. However one focus of the invention was to substitute CVD coatings in applications of high thermochemical and/or abrasive wear as for instance with high speed milling of iron, steel and hardened materials as well as turning of steel, iron, as e.g. cast iron, superalloys and hardened materials.

PVD coatings of the following examples have been deposited by a cathodic arc process; deposition temperature was between 500° C. with comparative TiCN coatings and 550° C. for oxidic coatings. For oxidic PVD coatings substrate bias has been pulsed and a small vertical magnetic field having a vertical field component of 3 to 50 Gauss and an essentially smaller horizontal component has been applied. With experiments 25, 28, 35, 37 an additional pulse signal has been superimposed to the DC current of the $Al_{0.6}Cr_{0.4}$ ($Al_{0.6}V_{0.4}$) arc sources. Details of such or similar applicable oxide coating processes can be found in WO 2006-099758 and other documents incorporated by reference. Layer thickness of TiN and TiCN interlayers between the substrate and a top oxidic layer) was between 0.5 to 1.5 μm.

Comparative CVD coatings have been deposited with MTCVD and deposition temperatures of 850° C.

EXAMPLE A

Milling of Alloy Steel AISI 4140 (DIN 1.7225)

Tool: indexable face mill, one insert z=1
Tool diameter: d=98 mm
Cutting speed: $v_c$=152 m/min
Feed rate: $f_z$=0.25 mm/tooth
Depth of cut: dc=2.5 mm
Process: down milling with coolant
Insert type: Kennametal SEHW 1204 AFTN, 12 wt % Co; chamfered sharp cutting edges for PVD coating, chamfered and honed to a very slight 40 μm radius for CVD coating.

TABLE 1

| Exp. Nr. | Type | d [μm] | Coating layers | | | Tool life [mm of cut] |
|---|---|---|---|---|---|---|
| 1 | MTCVD | 5.0 | — | TiCN | — | 5.050 ± 500 |
| 2 | PVD | 3.5 | — | TiCN | — | 4.300 ± 50 |
| 3 | PVD | 3.5 | — | TiAlN | — | 4.550 ± 80 |
| 4 | PVD | 4.0 | — | AlCrN | — | 4.600 ± 100 |
| 5 | PVD | 4.5 | TiN | $(AlCr)_2O_3$ | — | 5.100 ± 90 |
| 6 | PVD | 5.0 | TiN | TiCN | $(AlCr)_2O_3$ | 5.300 ± 120 |

EXAMPLE B

Milling of Alloy Steel AISI 4140 (DIN 1.7225)

Tool: indexable face mill, one insert z=1
Tool diameter: d=98 mm
Cutting speed: $v_c$=213 m/min
Feed rate: $f_z$=0.18 mm/tooth
Depth of cut: dc=2.5 mm
Process: down milling, no coolant
Insert type: Kennametal SEHW 1204 AFTN, 12 wt % Co; Edge preparation see example A.

TABLE 2

| Exp. Nr. | Type | d [μm] | Coating layers | | | Tool life [mm of cut] |
|---|---|---|---|---|---|---|
| 7 | MTCVD | 5.0 | — | TiCN | — | 9.300 ± 800 |
| 8 | PVD | 3.5 | — | TiCN | — | 8.000 ± 150 |
| 9 | PVD | 4.5 | TiN | $(AlCr)_2O_3$ | — | 10.100 ± 90 |
| 10 | PVD | 5.0 | TiN | TiCN | $(AlCr)_2O_3$ | 10.300 ± 100 |
| 11 | PVD | 3.5 | TiN | $(AlV)_2O_3$ | — | 8.900 ± 50 |
| 12 | PVD | 4.0 | TiN | TiCN | $(AlV)_2O_3$ | 9.400 ± 80 |

EXAMPLE C

Milling of Alloy Steel AISI 4140 (DIN 1.7225)

Tool: indexable face mill, one insert z=1
Tool diameter: d=98 mm
Cutting speed: $v_c$=260 m/min
Feed rate: $f_z$=0.20 mm/tooth
Depth of cut: dc=3.125 mm
Process: down milling
Insert type: Kennametal SEHW 1204 AFTN,
Exp. 13, 15, 17, 19 Co 6.0 weight % enriched carbide grade, 10.4 weight % cubic carbides.
Exp. 14, 16, 18, 20 Co 6.0 weight % non enr. carbide grade, 10.4 weight % cubic carbides.
Edge preparation see example A.

TABLE 3

| Exp. Nr. | Type | d [μm] | Coating layers | | | Tool life [minutes] |
|---|---|---|---|---|---|---|
| 13 | MTCVD | 8.0 | TiN | TiCN | TiN | 12.1 ± 2.0 |
| 14 | MTCVD | 8.0 | TiN | TiCN | TiN | 6.0 ± 4.0 |
| 15 | PVD | 4.0 | — | TiN | — | 6.2 ± 2.0 |
| 16 | PVD | 4.0 | — | TiN | — | 5.5 ± 2.0 |
| 17 | PVD | 4.5 | TiN | $(AlCr)_2O_3$ | — | 13.3 ± 1.5 |
| 18 | PVD | 5.0 | TiN | $(AlCr)_2O_3$ | — | 12.1 ± 2.0 |
| 19 | PVD | 3.5 | TiN | TiCN | $(AlV)_2O_3$ | 14.6 ± 2.0 |
| 20 | PVD | 4.0 | TiN | TiCN | $(AlV)_2O_3$ | 13.8 ± 3.0 |

Example C, experiment 14 clearly shows the detrimental influence of the CVD process to non enriched carbide grades, which is due to as mentioned process effects. On the other side the beneficial influence of a Co-enriched surface zone shows only limited effects with PVD coatings. Advantage of PVD coatings comprising an oxidic layer is obviously as is with examples A and B.

EXAMPLE D

Turning of Stainless Steel AISI 430F (DIN 1.4104)

Cutting speed: $v_c$=200 m/min
Feed rate: $f_z$=0.20 mm/tooth
Depth of cut: dc=1.0 mm
Process: continuos turning of outer diameter
Insert type: Cermet grade, ISO VNMG 160408All, sharp cutting edges for PVD coating, chamfered and honed to a slight 60 μm radius before CVD coating.

TABLE 4

| Exp. Nr. | Type | d [μm] | Coating layers | | | Tool life [pieces per edge] |
|---|---|---|---|---|---|---|
| 22 | MTCVD | 8.0 | — | TiCN | — | 350 ± 55 |
| 22 | PVD | 5.0 | — | TiN | — | 275 ± 10 |
| 23 | PVD | 4.5 | — | $(AlCr)_2O_3$ | — | 340 ± 15 |
| 24 | PVD | 6.0 | TiN | $(AlCr)_2O_3$ | — | 420 ± 25 |
| 25 | PVD | 6.5 | TiN | TiCN | $(AlCr)_2O_3$ | 450 ± 30 |
| 26 | PVD | 5.5 | — | $(AlV)_2O_3$ | — | 360 ± 20 |
| 27 | PVD | 7.0 | TiN | $(AlV)_2O_3$ | — | 385 ± 20 |
| 28 | PVD | 7.5 | TiN | TiCN | $(AlV)_2O_3$ | 410 ± 35 |
| 29 | PVD | 3.0 | — | $(AlZr)_2O_3$ | — | 335 ± 20 |
| 30 | PVD | 5.5 | TiN | $(AlZr)_2O_3$ | — | 380 ± 30 |
| 31 | PVD | 6.0 | TiN | TiCN | $(AlZr)_2O_3$ | 380 ± 25 |

Additionally to the influence of the coating type and material there can be seen a clear beneficial influence of layer thickness with oxidic PVD coatings. Nevertheless even most thin oxidic PVD coatings show a better performance than thick MTCVD-coating from experiment 22.

EXAMPLE E

Turning of Grey Cast Iron

Cutting speed: $v_c$=550 m/min
Feed rate: $f_z$=0.65 mm/tooth
Depth of cut: dc=5.0 mm
Process: continuos turning of outer diameter
Insert type: Ceramic, $Al_2O_3$—TiC 20%, ISO RNGN 120400T, sharp cutting edges for PVD coating, chamfered and honed to a slight 50 μm radius before CVD coating.

TABLE 5

| Exp. Nr. | Type | d [μm] | Coating layers | | | Tool life [pieces per edge] |
|---|---|---|---|---|---|---|
| 32 | MTCVD | 8.0 | TiCN | $Al_2O_3$ | — | 23 ± 5 |
| 33 | PVD | 3.5 | — | TiCN | — | 8 ± 1 |
| 34 | PVD | 6.0 | TiN | $(AlCr)_2O_3$ | — | 30 ± 2 |
| 35 | PVD | 6.5 | TiN | TiCN | $(AlCr)_2O_3$ | 34 ± 3 |
| 36 | PVD | 7.0 | TiN | $(AlV)_2O_3$ | — | 32 ± 3 |
| 37 | PVD | 7.5 | TiN | TiCN | $(AlV)_2O_3$ | 36 ± 3 |

EXAMPLE F

Turning of Forging Steel _AISI 4137H (DIN 1.7225)

Cutting speed: $v_c$=100 m/min
Feed rate: $f_z$=0.80 mm/tooth
Depth of cut: dc=5-15 mm
Process: continuos turning of outer diameter
Insert type: Cemented carbide, 6% non enriched, ISO TNMG 330924.
Sharp cutting edges for PVD coating, chamfered and honed to a slight 50 μm radius before CVD coating.

TABLE 6

| Exp. Nr. | Type | d [μm] | Coating layers | | | Tool life [pieces per edge] |
|---|---|---|---|---|---|---|
| 32 | CVD | 8.0 | TiC | TiCN | TiN | 7 ± 2 |
| 33 | PVD | 3.5 | — | TiCN | — | 3 ± 1 |
| 34 | PVD | 6.0 | TiN | $(AlCr)_2O_3$ | — | 14 ± 1 |
| 35 | PVD | 6.5 | TiN | TiCN | $(AlCr)_2O_3$ | 15 ± 2 |
| 36 | PVD | 7.0 | TiN | $(AlV)_2O_3$ | — | 14 ± 2 |
| 37 | PVD | 7.5 | TiN | TiCN | $(AlV)_2O_3$ | 16 ± 3 |

It could be demonstrated by examples A to F that oxidic coatings can be beneficially applied on sharp edged tools by PVD coating processes. A sharp edge is desirable because it leads to lower cutting forces, reduced tool-tip temperatures to a finer workpiece surface finish and to an essential improvement of tool life.

What is claimed is:

1. A method for manufacturing a cutting tool comprising the steps of providing a body of cermet or cemented carbide, having a cutting edge with an edge radius $R_e$ smaller than 40 μm, a flank a rake face, applying by PVD a single or a multilayer coating to at least a part of the surface of the body, comprising at least a part of the cutting edge, and applying by PVD said single or multilayer coating, comprising PVD coating with at least one oxidic layer.

2. The method of claim 1 comprising applying by PVD said single or multilayer coating free of thermal cracks.

3. The method of claim 1, wherein the oxidic layer comprises an electrically insulating oxide of at least one element selected from the group of transition metals of IV, V, VI group of the periodic system and Al, Si, Fe, Co, Ni, Y and La.

4. The method of claim 3, said oxidic layer comprising a cubic structure.

5. The method of claim 3, wherein said oxidic layer comprises a hexagonal crystal structure.

6. The method of claim 4, wherein said oxidic layer comprises an $(Al_{1-x}Cr_x)_2O_3$ compound.

7. The method of claim 5, wherein said oxidic layer comprises an $(Al_{1-x}Cr_x)_2O_3$ compound.

8. The method of claim 1, wherein said oxidic layer comprises a corundum type structure.

9. The method of claim 8, wherein said corundum type structure is corundum or is a multiple oxide having the following composition: $(Me1_{1-x}Me2_x)_2O_3$, wherein $0.2 \leqq x \leqq 0.98$ and Me1 and Me2 are different elements selected from the group consisting of Al, Cr, Fe, Li, Mg, Mn, Nb, Ti, Sb and V.

10. The method of claim 9, wherein said corundum type structure is $(AlCr)_2O_3$ or $(AlV)_2O_3$.

11. The method of claim 1, wherein said oxidic layer comprises films of different oxides.

12. The method of claim 11, further comprising PVD depositing an adhesion layer directly on said body and at least one hard wear protective layer between said adhesion layer and said oxidic layer, said adhesion layer and said hard wear protective layer comprising at least one element selected from the group of transition metals from group IV, V, VI of the periodic system of the elements and of Al, Si, Fe, Ni, Co, Y and La.

13. The method of claim 12, wherein elements of said hard protective layer comprise compounds of N, C, O, B or a mixture thereof.

14. The method of claim 12, wherein said at least one hard wear protective layer comprises at least one composition segregated film.

15. The method of claim 12, wherein elements of said adhesion layer comprise compounds of N, C, O, or a mixture thereof.

16. The method of claim 12, comprising depositing said adhesion layer with a thickness of between 0.1 μm and 1.5 μm.

17. The method of claim 12, wherein said adhesion layer comprises a metallic layer directly on said surface of said body.

18. The method of claim 12, further comprising depositing said hard wear protective layer between two consecutive oxidic layers.

19. The method of claim 1, comprising PVD depositing said single or multilayer coating with a thickness of between 2 μm and 30 μm.

20. The method of claim 1, further comprising providing said body of a material which is not binder enriched.

21. The method of claim 1, further comprising providing said body of a material which is binder enriched.

22. The method of claim 1, further comprising PVD coating said flank with said single or multilayer coating and with a first thickness and PVD coating said rake face with said single or multilayer coating with a second thickness, said first and second thicknesses being different.

23. The method of claim 22, wherein said cutting tool is a milling tool having a quotient $Q_{R/F}=d_{Rake}/d_{Flank}<1$, where $d_{Rake}$ is the overall coating thickness on the rake face and $d_{Flank}$ is the overall coating thickness on the flank.

24. The method of claim 22, wherein the tool is a turning tool having a quotient $Q_{R/F}=d_{Rake}/d_{Flank}>1$, where $d_{Rake}$ is the overall coating thickness on the rake face and $d_{Flank}$ is the overall coating thickness on the flank.

25. The method of claim 1, wherein said cutting tool is an indexable insert.

26. The method of claim 12, wherein the cutting tool is a gear cutting tool, a hob or shank type tool having said oxidic layer deposited as the outermost layer of said PVD coating.

27. The method of claim 26, wherein said hard wear protective layer is deposited between said body and said oxidic layer and is of a material selected from the group consisting of TiN, TiC, TiCN, TiAlN, TiAlCN, AlCrN and AlCrCN.

28. The method of claim 1, wherein said oxide layer is deposited by cathodic arc evaporation.

29. The method of claim 1, wherein said single or multiple coating is deposited by cathodic arc evaporation.

30. The method of claim 29, wherein said oxide layer is deposited in a pure oxygen atmosphere.

* * * * *